US005854732A

United States Patent [19]

Murray

[11] Patent Number: 5,854,732

[45] Date of Patent: Dec. 29, 1998

[54] HIGH VOLTAGE ARCING SWITCH INITIATED BY A DISRUPTION OF THE ELECTRIC FIELD

[75] Inventor: Michael Murray, Palm City, Fla.

[73] Assignee: Argus Photonics Group, Inc., Jupiter, Fla.

[21] Appl. No.: 813,289

[22] Filed: Mar. 10, 1997

[51] Int. Cl.[6] ..... H01J 5/06

[52] U.S. Cl. ..... 361/120; 361/117; 361/120; 361/121; 361/130; 313/146; 313/149

[58] Field of Search ..... 361/117, 120, 361/121, 130; 313/146, 149

[56] References Cited

U.S. PATENT DOCUMENTS

| | | | |
|---|---|---|---|
| 1,758,181 | 5/1930 | Steinmayer . | |
| 3,211,940 | 10/1965 | Hueschen | 313/205 |
| 3,275,891 | 9/1966 | Swanson . | |
| 3,492,532 | 1/1970 | Fayling . | |
| 3,538,382 | 11/1970 | Smith, Jr. | 317/16 |
| 3,602,668 | 8/1971 | Krajewski et al. . | |
| 3,654,520 | 4/1972 | Graneau . | |
| 3,755,715 | 8/1973 | Klayum et al. . | |
| 3,811,064 | 5/1974 | Kawiecki . | |
| 3,811,070 | 5/1974 | Voshall | 315/150 |
| 3,866,091 | 2/1975 | Kawiecki . | |
| 4,275,317 | 6/1981 | Laudenslager et al. . | |
| 4,506,244 | 3/1985 | Jabagchourian et al. . | |
| 4,578,550 | 3/1986 | Efinger . | |
| 4,628,396 | 12/1986 | Flemming . | |
| 4,628,399 | 12/1986 | Shigemori et al. . | |
| 4,631,453 | 12/1986 | deSouza et al. . | |
| 4,663,568 | 5/1987 | Cohn . | |
| 4,707,619 | 11/1987 | Chu et al. . | |
| 4,924,346 | 5/1990 | Capps . | |
| 5,258,588 | 11/1993 | Micheletti et al. . | |
| 5,291,369 | 3/1994 | Kelch et al. . | |
| 5,313,145 | 5/1994 | Francis, Jr. et al. . | |
| 5,329,205 | 7/1994 | Goebel et al. . | |
| 5,359,307 | 10/1994 | Mahoney et al. . | |
| 5,391,961 | 2/1995 | Tsuchiya et al. . | |
| 5,394,128 | 2/1995 | Perreira et al. . | |
| 5,395,394 | 3/1995 | Cameron . | |
| 5,465,030 | 11/1995 | Smith . | |
| 5,483,214 | 1/1996 | Perreira et al. . | |
| 5,519,370 | 5/1996 | Perreira et al. . | |
| 5,562,464 | 10/1996 | Lecourtois . | |

*Primary Examiner*—Ashok Patel
*Assistant Examiner*—Matthew J. Gerike
*Attorney, Agent, or Firm*—Quarles & Brady

[57] ABSTRACT

A high voltage switch, including: first and second electrodes having electrode surfaces; an electrically non conductive tube having an outer surface connecting the electrode surfaces; an electrically non conductive wall surrounding the tube and forming an enclosure in which the electrode surfaces and the outer tube surface are sealed; an ionizable material in the enclosure, an electric field being created in the enclosure responsive to application of a high voltage potential across the electrodes; and, an electrically conductive member adapted for movement in the tube between a first position substantially inside the enclosure and a second position substantially outside the enclosure, the electrically conductive member distorting the electric field when moved into the first position and causing an ionized current flow path between the electrode surfaces. A plurality of such switches can be ganged for simultaneous and/or sequential operation.

20 Claims, 4 Drawing Sheets

HIGH VOLTAGE ARCING SWITCH INITIATED BY A DISRUPTION OF THE ELECTRIC FIELD

BACKGROUND OF THE INVENTION

1. Field of the Invention

This invention relates to the field of high voltage switches, and in particular, electric field distortion switches.

2. Description of Art

Many circuits require the rapid and successive application of high voltage potentials and/or large currents to a load. Voltages on the order of, for example 25 Kilovolts (Kv) or more, and currents on the order of kiloamperes can be required. Mechanical switches are not well suited for switching such high voltages. The switch contacts are prone to rapid degradation from erosion and pitting due to arcing between the switch contacts. The damage is worse when the switch operates in an environment open to the air to due the further effects of oxidation.

One circuit in particular which requires the rapid and successive application of a high voltage potential and large current flow to a load is a pulsed gas discharge laser, for example a $CO_2$ TEA laser. Semiconductor switches do not have the voltage and current capacity, or sufficiently fast switching transient times, to operate reliably in such an environment. Electromechanical relays have been used, but they are subject to the kinds of damage described above.

Spark gap devices have been used in over voltage and over current protection circuits. A typical spark gap device has an ionizable gas in a chamber separating two electrodes. The spark gap devices are usually coupled in parallel with a circuit or device to be protected. When the voltage potential across the load, and across the spark gap, becomes high enough, an ionized current flow is established between the electrodes, thereby shunting the high potential around the circuit or device being protected.

Although spark gap devices have been well known, none of the advantages of spark gap technology have been applied to devices for switching high voltage potentials and large currents responsive to control signals, as opposed to operation responsive to transient or sporadic over voltage or over current conditions. Spark gap devices have been used to switch currents to other devices, as known from U.S. Pat. No. 3,275,891. Such triggered spark gaps work well when the switching application requires rapid switch closure, but do not work well when rapid opening of the switch is required, as in the case of an over voltage protection circuit. Triggered spark gaps do not allow rapid and successive application of high voltage because the ionized gas in a triggered spark gap does not de-ionize rapidly. De-ionization is slow because the arc is surrounded by gas which does not allow the arc to cool rapidly. The use of an electric field to actuate a particular kind of switch contact is known from U.S. Pat. No. 3,492,532. An ionized flow path in a spark gap device is used to displace a liquid magnetic and electrically conductive material into a position inside the spark gap device which physically connects the electrodes, thus replacing the ionized gas flow path with a direct connection.

A strong-felt need remains for a switch which can operate reliably at high voltage potentials and large current levels, and in an environment requiring rapid and repeated actuation, which is not subject to the deterioration common in mechanical high voltage relays and other such switches known in the art.

A strong-felt need also remains for a switch having the improved operating characteristics as described, which can conveniently be coupled in a ganged configuration responsive to a single control mechanism, to enable simultaneous actuation of a plurality of high voltage switches, sequential actuation of a plurality of high voltage switches, or a combination of simultaneous and sequential actuations.

SUMMARY OF THE INVENTION

An electric field distortion switch in accordance with the inventive arrangements taught herein overcomes all of the problems in prior art high voltage switches. Such switches can apply high voltage potentials, such as 25 kV or more, and can conduct large currents, such as on the order of kiloamperes, without suffering the damage and degradation of mechanical switches. In accordance with the inventive arrangements, all mechanical components are electrically insulated and atmospherically isolated from the electrodes of the switch contacts and the current flow path in the switch. Moreover, a switch in accordance with the inventive arrangements is suitable for rapid and repeated switching operation, such as required for operating pulsed gas discharge lasers. The electric field distortion switch behaves differently than a triggered spark gap because the arc is along the surface of a dielectric which conducts heat away from the arc. The close proximity of the dielectric surface to the ionized gas at the arc promotes rapid de-ionization of the gas and the return of the switch to the open circuit condition.

A high voltage switch in accordance with an inventive arrangement comprises: first and second electrodes having electrode surfaces; an electrically non conductive tube having an outer surface connecting the electrode surfaces; an electrically non conductive wall surrounding the tube and forming an enclosure in which the electrode surfaces and the outer surface of the tube are sealed; an ionizable material in the enclosure, an electric field being created in the enclosure responsive to application of a high voltage potential across the electrodes; and, an electrically conductive member adapted for movement in the tube between a first position substantially inside the enclosure and a second position substantially outside the enclosure, the electrically conductive member distorting the electric field when moved into the first position and causing an ionized current flow path to be established between the electrode surfaces. The ionized current flow path is generally along the outer surface of the tube.

The high voltage potential across the electrodes generates a substantially uniform electric field within the enclosure, between the electrode surfaces. The lines of flux in the field are generally parallel to the facing surfaces of the electrodes. Movement of the conductive member into the boundaries of the enclosure, inside the non conductive tube, has the effect of moving the lines of flux, and thereby concentrating the lines of flux, at or near the tip of the conductive member. As the tip of the conductive member is moved from the cathode electrode to the anode electrode, the lines of flux are, in effect, gathered up and pulled/pushed toward the anode electrode. When the tip comes sufficiently close to the anode electrode, an ionized current flow path is established from the anode to the cathode, generally along the outer surface of the non conductive tube, closing the switch. The electrode surfaces never touch one another. The ionizable material can be selected to minimize pitting and erosion, for example dry nitrogen gas. All of the mechanical elements which move the conductive member, as well as the conductive member itself, are electrically and mechanically isolated from the electrodes, from the ionizable gas and from the ionized current flow path.

A drive mechanism, for example actuated by a solenoid, can be used to move the conductive member back and forth inside the non conductive tube. The drive mechanism can be connected to a coupling member, for example an electrically non conductive member, having the electrically conductive member connected thereto, for movement together.

Means for supplying the ionizable material into the enclosure and means for exhausting the ionizable material from the enclosure can comprise intake and outlet valves or pinch-off tubes communicating with the interior of the enclosure, for example through holes in one of the electrodes. Pinch-off tubes are more economical than valves.

One or both of the electrode surfaces can be provided with a protective surface to prevent what damage may occur even in the protected environment of the enclosure.

A high voltage ganged switch in accordance with an inventive arrangement comprises: at least two pairs of electrodes, each of the electrode pairs having respective pairs of electrode surfaces; respective electrically non conductive tube portions having respective outer surfaces connecting the respective pairs of electrode surfaces; an electrically non conductive wall portion surrounding each of the respective tube portions and forming respective enclosures in which the respective pairs of electrode surfaces and the respective outer surfaces of the respective tube portions are sealed; an ionizable material in each of the enclosures, respective electric fields being created in the enclosures responsive to application of a high voltage potential across each of the pairs of electrodes; and, respective electrically conductive members adapted for movement in the respective tube portions between respective first positions substantially inside each of the respective enclosures and respective second positions substantially outside each of the respective enclosures, the electrically conductive members distorting the respective electric fields when moved into the respective first positions and causing respective ionized current flow paths between the respective pairs of electrode surfaces. The respective ionized flow paths are generally along the respective outer surfaces of the respective tube portions.

Simultaneous and/or sequential actuation can be achieved by controlling the instants of time at which the different conductive members are moved into their respective enclosures, between their respective electrodes. One inventive arrangement fixes the respective switches at locations separated by fixed and equally spaced intervals. Conductive and non conductive members can be connected to one another, in an alternating arrangement. The entire arrangement is moved together as a single unit. The spacing between the conductive members is related to the spaced intervals between the switches. The same spacing will result in simultaneous actuation of the switches. A different spacing will result in sequential actuation of the switches. A mixture of same and different spacing will result in both simultaneous and sequential operation. Alternatively, the spacing of the conductive members can be uniform and the spacing between adjacent switches can be adjusted.

DETAILED DESCRIPTION OF THE PREFERRED EMBODIMENTS

Figure 1:
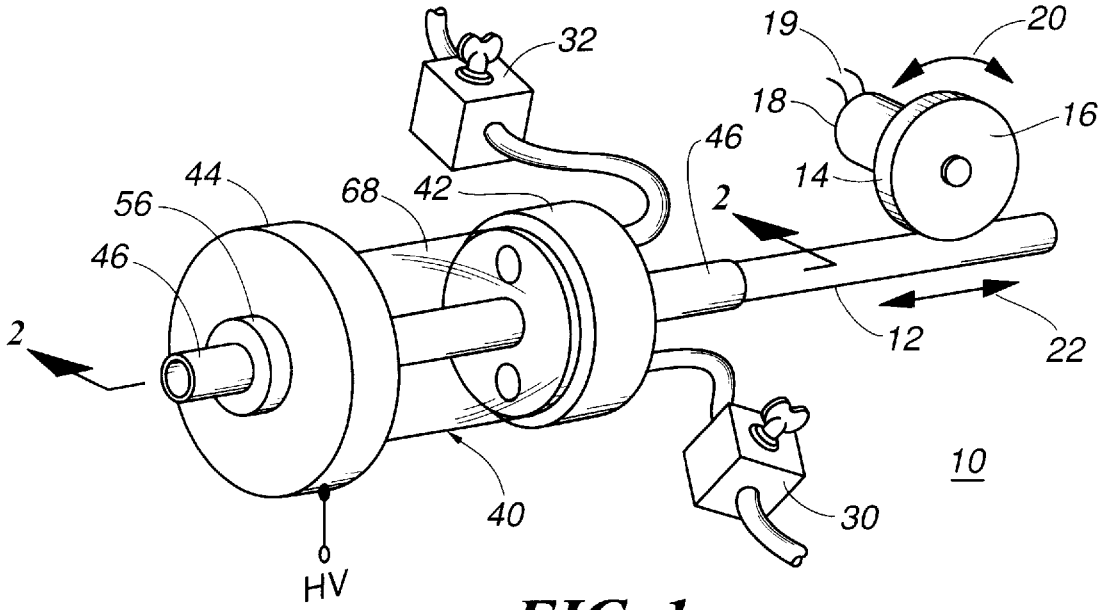
FIG. 1 is a perspective view of an electric field distortion switch according to an inventive arrangement.
Figure 2:
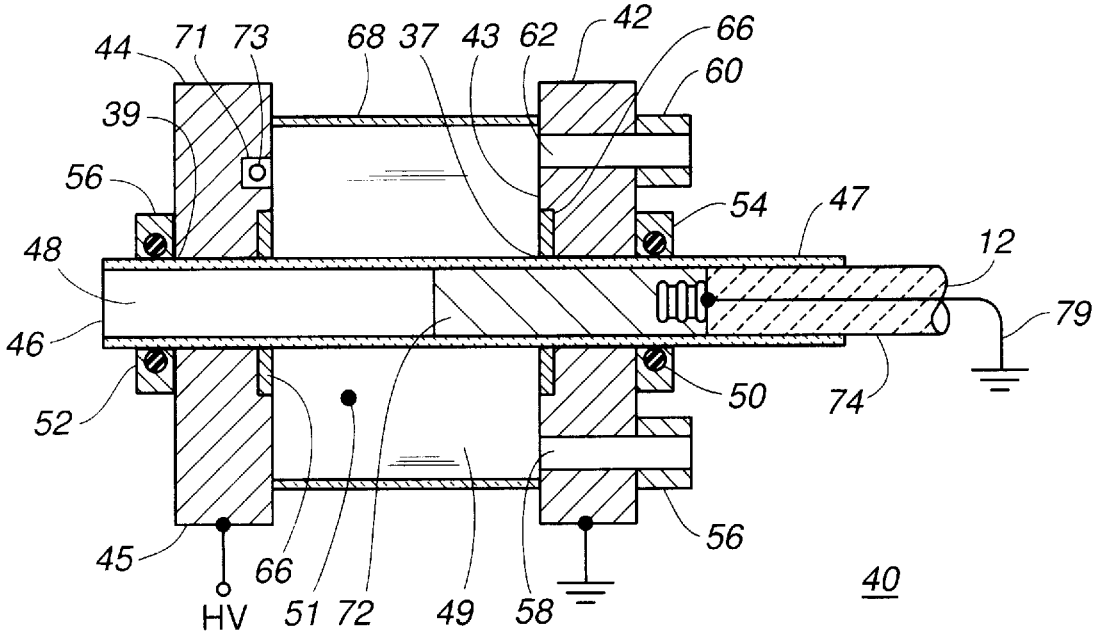
FIG. 2 is a section view taken along the line II—II in FIG. 1.

FIGS. 1 and 2 illustrate an electric field distortion, high voltage switching mechanism 10. The switching mechanism 10 comprises a switch assembly 40, including an actuating rod assembly 12, and a drive mechanism 14 for moving the actuating rod assembly 12 back and forth to cause actuation and deactuation of the switch assembly. One of the electrodes, electrode 44 in the drawings, forms an anode terminal of the switch assembly. The other of the electrodes forms a cathode terminal of the switch assembly 40. Although the shape of the electrodes is illustrated as being cylindrical or disk shaped, this shape is not critical. Square or rectangular electrodes, for example, have flat edges which can be utilized for mounting the switch assembly on a support member, not shown. The anode and cathode terminals are coupled across a source of high voltage potential HV, for example on the order of 25 kV, or more. Anode electrode 44 is designated HV and cathode terminal 42 is designated by a ground symbol.

The switch assembly 40 comprises first and second annular electrodes 42 and 44, having electrode surfaces 43 and 45 respectively. The electrodes are made from an electrically conductive material, such as aluminum or stainless steel. An electrically non conductive tube 46 has an outer surface 47 connecting the electrodes and electrode surfaces. The tube 46 is preferably made from a high temperature resistant and chemically inert material. A ceramic material, for example alumina (aluminum oxide) is suitable.

An electrically non conductive annular wall 68 surrounds the tube 46 and forms an enclosure 49 in which the electrode surfaces 43 and 45 and the outer surface 47 of the tube are sealed. The wall 68 is conveniently formed by a transparent material, so that the switching actuation may be observed. Suitable materials include glass or a ceramic material. Except as specifically noted, the manner in which the various elements forming the enclosure 49 are sealed to one another is omitted for purposes of clarity. Many suitable adhesive materials and/or O-ring arrangements can be utilized. Such materials are also preferably high temperature resistant and chemically inert.

The sealing arrangement between the tube 46 and the holes 37 and 39, through the centers of the electrodes 42 and 44 respectively, is shown in FIGS. 1 and 2. The seal is implemented by O-rings 50 and 52, disposed in retaining blocks 54 and 56 respectively.

An ionizable material represented by reference numeral 51 is disposed in the enclosure 49. A material other than air is preferred, in order to avoid oxidation damage. A suitable material is dry nitrogen gas. Other gaseous and liquid ionizable materials, that is, non solids, may be utilized, depending on the desired operating characteristics. Different materials will be prone to ionize at different magnitudes of high voltage potential, depending upon pressure, temperature and the like.

One of the electrodes, for example electrode 42 as shown in the drawings, is provided with two bores or holes 58 and 62, communicating between the interior and exterior of the enclosure 49. Fittings 56 and 60 couple the interior of the enclosure to respective valves 30 and 32, through hoses as shown. One of valves 30 and 32 is coupled to a pressurized source of a suitable ionizable material and the other is coupled to an exhaust port, not shown, through further hoses.

A cylindrical, electrically conductive member 72 is adapted for movement in the tube 46, between a first position substantially inside the enclosure 49, that is, between the electrodes 42 and 44, and a second position substantially outside the enclosure 49. The electrically conductive member 72 is carried on the end of an electrically non conductive member, rod 74. Rod 74 can be electrically conductive if its travel path does not affect operation of the switch. This can be the case for the embodiments of FIGS. 1–5 and 8, but is problematic in the ganged switches of FIGS. 6 and 7. Electrically non conductive member 74 need not be a high temperature resistant and chemically inert material, because it is not exposed to the arc discharge. Plastic or glass fiber rods are suitable. The electrically conductive and non conductive members 72 and 74 must be connected end to end by an arrangement which does not result in an air gap between electrically conductive member 72 and the inside surface of tube 46. The arrangement may utilize, for example, threaded coupling 78, as shown in FIG. 2, or adhesive bonding as indicated in FIGS. 3–8, a layer of adhesive being too thin to illustrate in the scale of drawings. In FIG. 2, threaded coupling 78 comprises a threaded projection on member 74 and a mating threaded bore in member 72. The electrically conducting member 72 is electrically coupled to the cathode electrode 42 by grounding wire 79, which extends through member 74.

The free end of the rod 74 is engaged by the drive mechanism 14 for reciprocal movement inside tube 46, as indicated by arrow 22. The drive mechanism 14 comprises a disk 16, an edge of which engages the outer surface of rod 72, by friction or by a gear assembly, not shown. The disk is moved reciprocally, clockwise and counter clockwise as shown by arrow 20, by a solenoid, stepping motor or other suitable means, generally designated by reference numeral 18. Disk mover 18 is connected to a control source, not shown, by wires 19.

Figure 3:
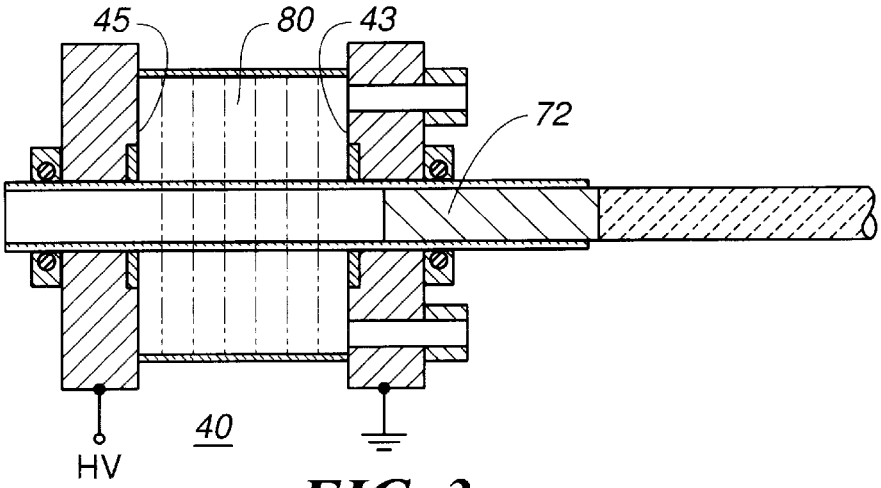
FIGS. 3–5 are section views similar to FIG. 2, but in smaller scale, useful for explaining the operation of the electric field distortion switch shown in FIGS. 1 and 2.

A uniform electric field 80 is created in the enclosure 49 responsive to application of the high voltage potential HV across the electrodes 42 and 44. The electric field 80 is diagrammatically shown in FIGS. 3–5 by illustrative flux lines. Most of the reference numerals identified in FIG. 2 and the grounding wires are omitted for purposes of clarity. As long as the electrically conductive member is outside the enclosure, as shown in FIG. 3, the lines of flux in the field 80 are generally parallel to the facing surfaces 43 and 45 of the electrodes, as shown in FIG. 3.

Figure 4:
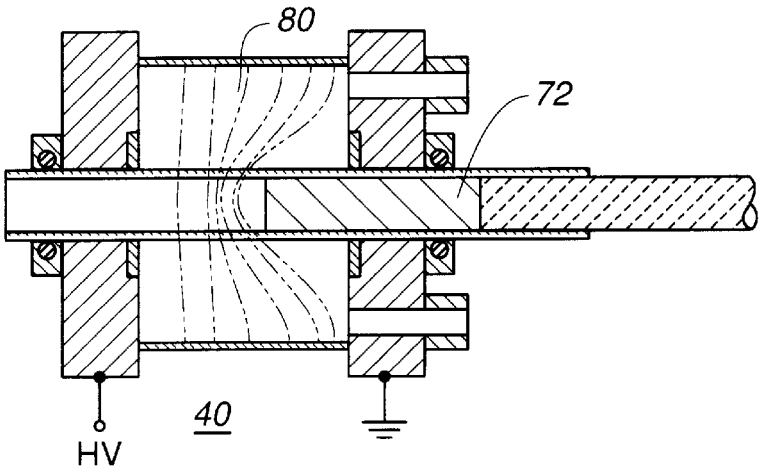

Movement of the conductive member 72 into the boundaries of the enclosure 49, within the non conductive tube 46, has the effect of moving the lines of flux, and thereby concentrating the lines of flux, at or near the free end, or tip, of the conductive member. An intermediate position is shown in FIG. 4.

Figure 5:
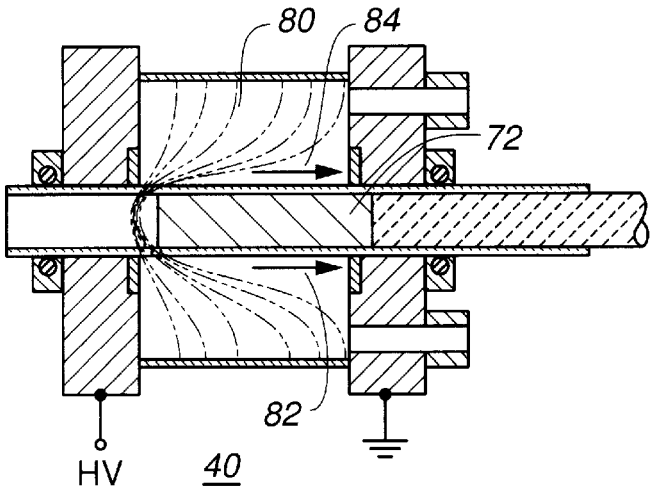

When the electrically conductive member 72 comes sufficiently close to the anode electrode 44, substantially fully in the first position as shown in FIG. 5, the electric field is maximally concentrated and distorted. As a result, an ionized current flow path between the electrode surfaces 44 and 42, and along the outer surface 47 of the tube 46, is established. The ionized current flow path is diagrammatically indicated by arrows 82 in FIG. 5.

The ionized current flow path is generally along the entire outer surface of the non conductive tube, closing the switch and allowing the high voltage to be instantly supplied to the load, for example a gas discharge laser. The ionized current flow path is concentrated at, and leaves the electrode surface 45, close to the outer surface 47 of tube 46. The ionized current flow path tends to spread out radially as it approaches the electrode surface 43, and accordingly, damage to this electrode surface is much less likely. The concentration of the ionized current flow path at the electrode surfaces 43 and 45 can result in some damage to the electrode surface. A protective surface generally resistant to such damage can be provided by press fitting a washer 66 into each of the electrodes 42 and 44, as shown in FIGS. 2–7. The washer is preferably high temperature resistant and not subject to pitting or other corrosion. Suitable materials for the washers 66 include tungsten copper alloys and molybdenum.

The dimensions of the switch assembly will depend upon the requirements of the switching circuit and the load. A gap between the electrodes of about one inch is appropriate for switching a high voltage potential of about 25 kV. The gap would be larger for higher voltage potentials. The non conductive tube can have an outer diameter of about 0.4 inches and an inner diameter of about 0.3 inches. The conductive and non conductive members constituting the actuating rod assembly can have a diameter of about 0.29 inches. The diameter of the electrodes and the enclosure 68 should be about 5–10 times larger than the outer diameter of the non conductive tube, to prevent an ionized current flow path being established along the inside surface of the enclosure. The diameter of the electrodes and the enclosure should also be large enough to accommodate the fittings for supplying and exhausting the ionizable material. The enclosure 68 should be thick enough to withstand the pressure within the enclosure. Many ionizable materials, including the dry nitrogen, can be used at atmospheric pressure. The washer can be about 0.1 inches thick, have an inner diameter corresponding to the outer diameter of the tube 46 and have an outer diameter of at least about one inch.

The dimensions will also depend upon the characteristics of the ionizable material, particularly the ionization threshold of the material. It is possible to make the switch assembly more sensitive, that is, more likely to undergo ionized current flow at lower voltage levels or with less intrusion of the conductive member into the enclosure, by increasing the ionization level of the material beyond that level resulting from application of the high voltage potential across the electrodes. One means for achieving this result is to place a small quantity or charge of a radioactive isotope inside the enclosure. As shown in FIG. 2, one of the electrodes, preferably the anode electrode, has a small cavity 71 in which a charge of a radioactive isotope is disposed. Suitable materials include a radio isotope of krypton or americium 241.

It will be appreciated that the electrode surfaces never touch one another. The ionizable material can be selected to minimize pitting and erosion, for example dry nitrogen gas. All of the mechanical elements which move the conductive member, as well as the conductive member itself, are electrically and mechanically isolated from the electrodes, from the ionizable gas and from the ionized current flow path.

An additional factor to consider in selecting a suitable ionizable material and in selecting suitable materials from which to construct the switch mechanism is that many ionizable materials will break down to some extent due to the ionization and form acids which can attack the surfaces in the enclosure.

Figure 6:
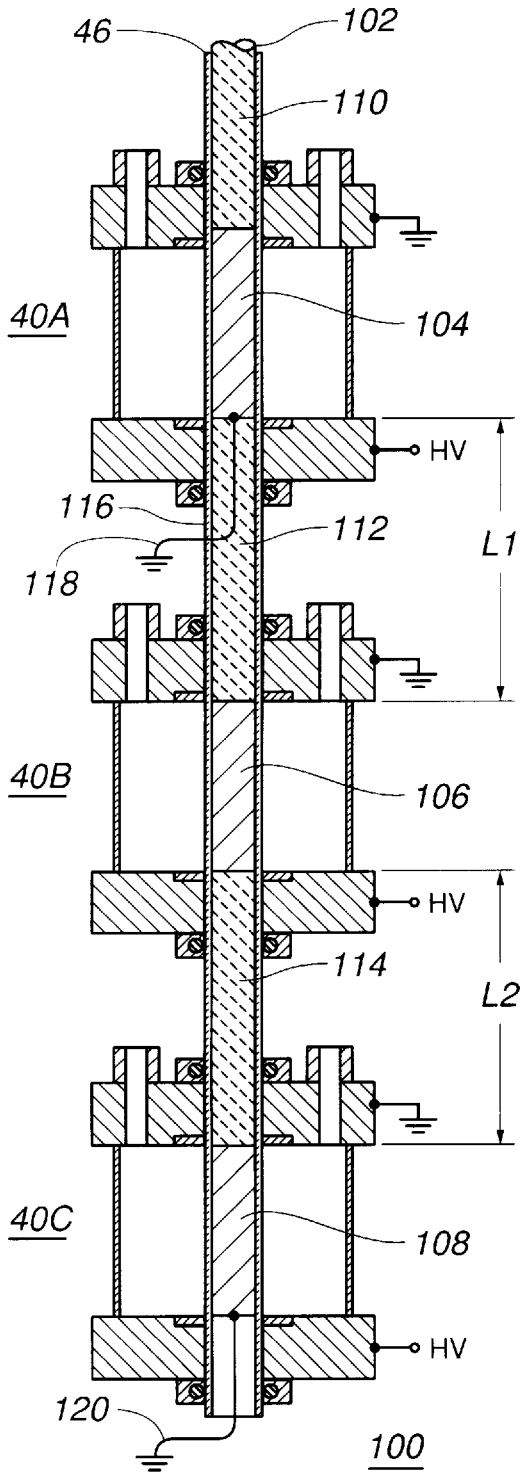
FIG. 6 is a section view of a first embodiment of a ganged electric field distortion switch having a plurality of switches, and adapted for simultaneous actuation of each switch.
Figure 7:
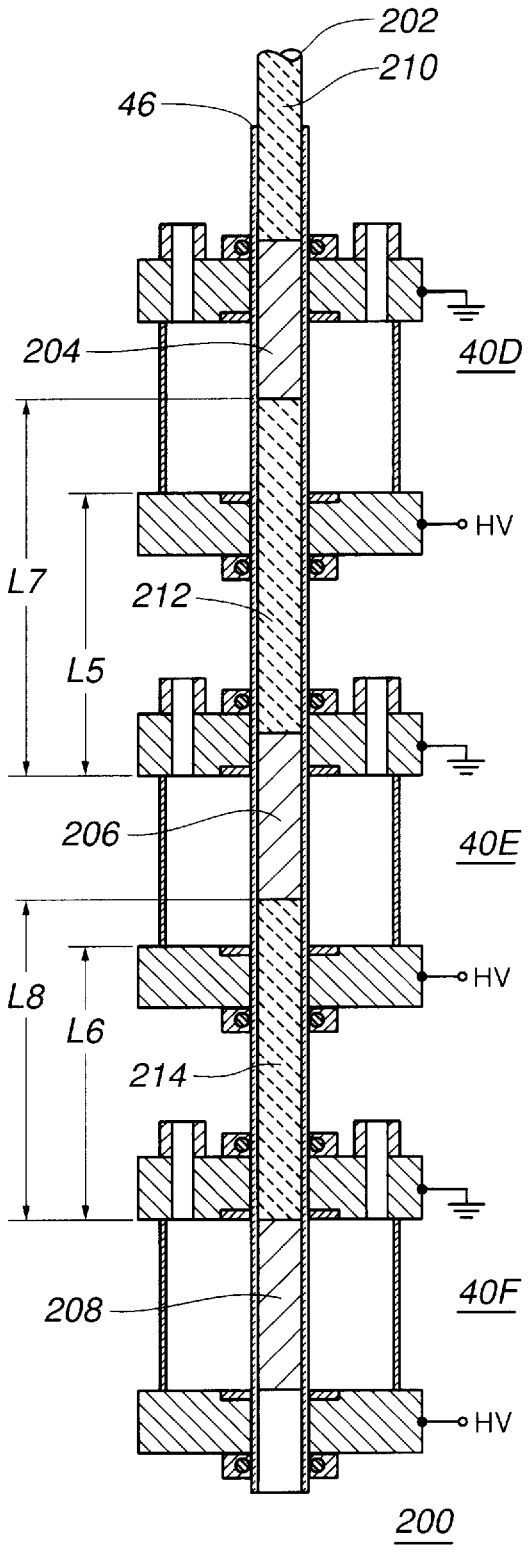
FIG. 7 is a section view of a second embodiment of a ganged electric field distortion switch having a plurality of switches, and adapted for sequential actuation of each switch.
Figure 8:
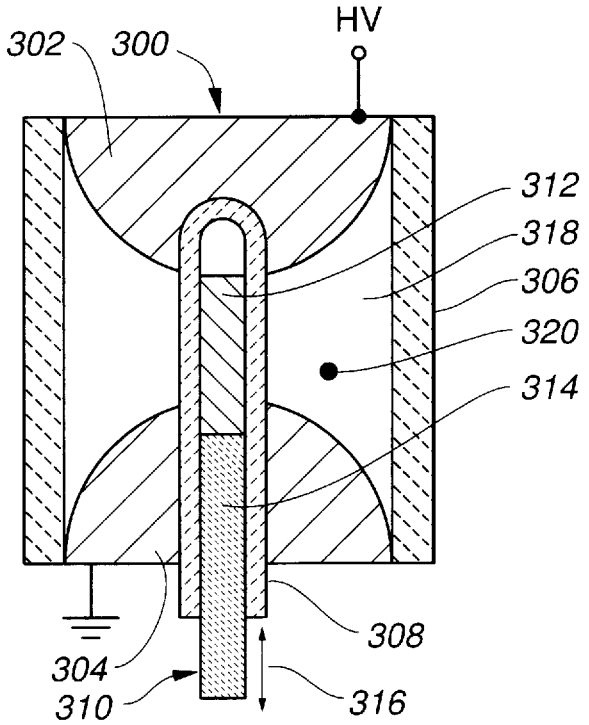
FIG. 8 is a diagrammatic illustration of an alternative embodiment.

Ganged electric field distortion high voltage switches 100 and 200 are shown in FIGS. 6 and 7 respectively. Ganged switch 100 is adapted for simultaneous actuation of all its constituent switch assemblies. The ganged switch 200 is adapted for sequential actuation of each of its constituent switch assemblies. The switch assemblies shown in FIGS. 6 and 7 are generally similar to those shown in FIGS. 2–5, and accordingly, most of the reference numerals identified in FIGS. 2–5 are omitted for purposes of clarity.

With reference to FIG. 6, three switch assemblies 40A, 40B and 40C are disposed along a non-conductive tube 46. An actuating rod assembly 102 is slidably disposed inside tube 48. Actuating rod assembly 102 has three electrically conductive members 104, 106 and 108. Actuating rod assembly 102 also comprises three electrically non-conductive members, including rods 110, 112 and 114. The electrically conductive and non-conductive members are connected to one another in an alternating fashion.

Two lengths L1 and L2 are indicated. Length L1 corresponds to the distance between adjacent electrode surfaces of adjacent switch assemblies 40A and 40B. Length L1 also corresponds to the length of non-conductive member 112. Similarly, length L2 corresponds to the distance between adjacent electrode surfaces of adjacent switch assemblies 40B and 40C, and also to the length of non-conductive member 114. Lengths L1 and L2 are equal to one another. In this configuration, each of the switch assemblies 40A, 40B and 40C will be actuated substantially simultaneously by movement of the rod assembly 102.

With reference to FIG. 7, switch assemblies 40D, 40E and 40F are disposed along non-conductive tube 46. An actuating rod assembly 202 comprises three electrically conductive members 204, 206 and 208, as well as three electrically non-conductive members 210, 212 and 214. As in the embodiment shown in FIG. 6, the conductive and non-conductive members are connected to one another in an alternating fashion. Length L5 indicates the distance between adjacent electrode surfaces of adjacent switch assemblies 40D and 40E. Length L6 indicates the distance between the adjacent electrode surfaces or adjacent switch assemblies 40E and 40F. Lengths L5 and L6 are equal to one another, and are also equal to lengths L1 and L2.

Length L7 indicates the length of non-conductive member 212 and length L8 indicates the length of non-conductive member 214. Lengths L7 and L8 are equal to one another, but are greater than lengths L5 and L6. As a result, the relative positions of conductive members 204, 206 and 208 are staggered with respect to their respective switch assemblies. As shown, conductive member 208 is disposed fully within the enclosure of switch assembly 40F. Conductive member 206 has only about 75% of its length within the enclosure of switch assembly 40E. Conductive member 204 has only about 50% of its length within the enclosure of switch assembly 40D. If one assumes that the actuating rod assembly 202 is moving downwardly in the sense of FIG. 7, switch assembly 40F will be conducting. Surely thereafter, switch assembly 40E will begin conducting. Shortly after switch assembly 40E begins conducting, switch assembly 40D will begin conducting.

It will be appreciated that the sequential operation achieved in the embodiment shown in FIG. 7 can also be achieved by utilizing uniformly spaced conductive members, as in the embodiment of FIG. 6, with switch assemblies 40 which are not uniformly spaced. In fact, ganged switches providing both simultaneous and sequential actuation can be provided by controlling the relative lengths L5, L6, L7 and L8. Ganged switches can also be provided with two switch assemblies or more than three switch assemblies. The embodiments of FIGS. 6 and 7 are generally illustrative of the manner in which many such ganged switches can be implemented.

It will be appreciated that in FIGS. 6 and 7, most of the grounding wires of the respective conductive members must pass through an opening or slot 116 in the tube as shown by grounding wire 118 for conductive member 112. Grounding wire 120 exemplifies an exception. The remaining grounding wires are omitted for purposes of clarity. If the switch assemblies are independently supported, tube 46 need not extend between the switch assemblies, and the ground wires have greater freedom of movement.

An electric field distortion high voltage switch can be implemented in numerous embodiments and geometries different than the geometry shown in FIGS. 1–7. One such additional embodiment is shown diagrammatically, and in section view, in FIG. 8. A switch assembly 300 comprises hemispherical electrodes 302 and 304 mounted within an electrically nonconductive tube 306. A smaller diameter tube 308, closed at one end, extends entirely through electrode 304 and into electrode 302. An actuating rod assembly 310 comprises an electrically conductive member 312 and an electrically non-conductive member 314. The actuating rod assembly 310 is adapted for movement into and out of the tube 308, as indicated by arrow 316. The foregoing structure defines an enclosure 318, in which an ionizable material 320 is disposed.

When a high voltage potential HV is coupled across electrodes 302 and 304, an electric field is created symmetric about the central axis within the enclosure 318. When the electrically conductive member 312 enters the enclosure, between the electrodes, the electric field will be distorted and an ionized current flow path will be established, as explained in connection with FIGS. 1–5.

An electric field distortion high voltage switch has been described, which can operate reliably at high voltage potentials and large current levels, in an environment requiring rapid and repeated actuation, and which is not subject to the deterioration that mechanical high voltage relays and other such switches known in the art are prone. An electric field distortion ganged high voltage switch has also been described, which can be responsive to a single control mechanism, to enable simultaneous actuation of a plurality of high voltage switches, sequential actuation of a plurality of high voltage switches, or a combination of simultaneous and sequential actuations.

The inventive arrangements described herein are not limited to the precise arrangements and instrumentalities shown, and accordingly, reference should be made to the appended claims as indicating the scope of the inventive arrangements.

What is claimed is:

1. A high voltage switch, comprising:

first and second electrodes having electrode surfaces; an electrically non conductive tube having an outer surface connecting said electrode surfaces;

an electrically non conductive wall surrounding said tube and forming an enclosure in which said electrode surfaces and said outer surface of said tube are sealed;

an ionizable material in said enclosure, an electric field being created in said enclosure responsive to application of a high voltage potential across said electrodes; and, an electrically conductive member adapted for movement in said tube between a first position substantially inside said enclosure and a second position substantially outside said enclosure, said electrically conductive member distorting said electric field when moved into said first position and causing an ionized current flow path between said electrode surfaces.

2. The switch of claim 1, further comprising means for moving said electrically conductive member inside said tube.

3. The switch of claim 1, further comprising a coupling member having said electrically conductive member connected thereto, said electrically conductive and coupling members being movable together inside said tube.

4. The switch of claim 1, further comprising means for supplying said ionizable material into said enclosure and means for exhausting said ionizable material from said enclosure.

5. The switch of claim 1, wherein said ionizable material is a gas.

6. The switch of claim 1, wherein said ionizable material is a liquid.

7. The switch of claim 1, further comprising a radioactive isotope disposed in said enclosure.

8. The switch of claim 1, wherein said tube is substantially centered on said electrode surfaces.

9. The switch of claim 1, further comprising a protective surface on at least one of said electrode surfaces.

10. A high voltage ganged switch, comprising a plurality of switches as recited in claim 1 and having at least one of three modes of operation, including simultaneous operation, sequential operation and both simultaneous and sequential operation.

11. A high voltage ganged switch, comprising:

at least two pairs of electrodes, each of said electrode pairs having respective pairs of electrode surfaces;

respective electrically non conductive tube portions having respective outer surfaces connecting said respective pairs of electrode surfaces;

an electrically non conductive wall portion surrounding each of said respective tube portions and forming respective enclosures in which said respective pairs of electrode surfaces and said respective outer surfaces of said respective tube portions are sealed;

an ionizable material in each of said enclosures, respective electric fields being created in said enclosures responsive to application of a high voltage potential across each of said pairs of electrodes; and, respective electrically conductive members adapted for movement in said respective tube portions between respective first positions substantially inside each of said respective enclosures and respective second positions substantially outside each of said respective enclosures, said electrically conductive members distorting said respective electric fields when moved into said respective first positions and causing respective ionized current flow paths between said respective pairs of electrode surfaces.

12. The ganged switch of claim 11, further comprising means for moving said respective electrically conductive members inside said tube portions.

13. The ganged switch of claim 11, further comprising at least one electrically non conductive member having said respective electrically conductive members connected thereto, said at least one electrically non conductive member and said respective electrically conductive members being movable together inside said respective tube portions.

14. The ganged switch of claim 11, wherein said respective electrically conductive members are adapted for movement into and out of said respective first positions to initiate said respective ionized current flow paths substantially simultaneously.

15. The ganged switch of claim 11, wherein said respective electrically conductive members are adapted for movement into and out of said respective first positions to initiate said respective ionized current flow paths at different instants of time.

16. The ganged switch of claim 11, wherein said respective tube portions are part of a common tube, said at least two pairs of electrodes being separated from one another along said common tube.

17. The ganged switch of claim 16, further comprising an electrically non conductive member interconnecting said respective electrically conductive members, said electrically non conductive member and said respective electrically conductive members being movable together inside said common tube.

18. The ganged switch of claim 17, wherein said at least two pairs of electrodes are separated from one another along said common tube by a first length and said electrically non conductive member interconnecting said respective electrically conductive members has a second length, said respective ionized current flow paths being initiated at instants of time, relative to one another, depending upon the relative sizes of said first and second lengths.

19. The ganged switch of claim 18, comprising at least three of said pairs of electrodes.

20. The switch of claim 11, comprising at least three of said pairs of electrodes.

* * * * *